US010400484B2

(12) United States Patent
Didier et al.

(10) Patent No.: US 10,400,484 B2
(45) Date of Patent: Sep. 3, 2019

(54) INERTIA LOCK FOR VEHICLE LATCH

(71) Applicant: Inteva Products, LLC, Troy, MI (US)

(72) Inventors: Jean Bernard Didier, Anould (FR); Romain Bachelot, Séléstat (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 448 days.

(21) Appl. No.: 15/202,319

(22) Filed: Jul. 5, 2016

(65) Prior Publication Data

US 2017/0009493 A1 Jan. 12, 2017

(30) Foreign Application Priority Data

Jul. 6, 2015 (FR) ..... 15/56370

(51) Int. Cl.

| | |
|---|---|
| ***E05C 3/12*** | (2006.01) |
| ***E05B 77/06*** | (2014.01) |
| ***E05B 77/12*** | (2014.01) |
| ***E05B 79/04*** | (2014.01) |
| ***E05B 79/12*** | (2014.01) |

(Continued)

(52) U.S. Cl.

CPC ..... *E05B 77/06* (2013.01); *E05B 77/12* (2013.01); *E05B 79/04* (2013.01); *E05B 79/12* (2013.01); *E05B 79/20* (2013.01); *E05B 79/22* (2013.01); *E05C 3/124* (2013.01); *Y10T 292/1047* (2015.04); *Y10T 292/1052* (2015.04);

(Continued)

(58) Field of Classification Search

CPC ..... E05B 77/06; E05B 77/12; E05B 79/04; E05B 79/12; E05B 79/22; E05C 3/124; Y10T 292/1055; Y10T 292/1052; Y10T 292/1082; Y10T 292/1092; Y10T 292/1047

USPC ..... 292/223, 200, 201, 210, 216, DIG. 23, 292/DIG. 22

See application file for complete search history.

(56) References Cited

U.S. PATENT DOCUMENTS 4,783,102 A * 11/1988 Bernard ..... E05B 85/26 292/216
5,634,677 A * 6/1997 Buscher ..... E05B 81/06 292/216

(Continued)

FOREIGN PATENT DOCUMENTS

CN 101657590 A 2/2010
CN 101939499 A 1/2011

(Continued)

OTHER PUBLICATIONS

French Search Report for Application No. 1556370; dated Jun. 1, 2016.

(Continued)

*Primary Examiner* — Kristina R Fulton
*Assistant Examiner* — Faria F Ahmad
(74) *Attorney, Agent, or Firm* — Cantor Colburn LLP

(57) ABSTRACT

A vehicle latch is provided. The vehicle latch having: an inertia lever rotationally mounted to the latch for movement about an axis between a first position and a second position; and a lock link operatively coupled to the inertia lever such that movement of the inertia lever from the first position to the second position causes the lock link to move from a first position to a second position, wherein the latch is in a locked state when the lock link is in the second position.

16 Claims, 8 Drawing Sheets

(51) Int. Cl.
*E05B 79/20* (2014.01)
*E05B 79/22* (2014.01)

(52) U.S. Cl.
CPC .... *Y10T 292/1055* (2015.04); *Y10T 292/1082* (2015.04); *Y10T 292/1092* (2015.04)

(56) References Cited

U.S. PATENT DOCUMENTS 5,802,894 A * 9/1998 Jahrsetz ..... E05B 77/48 292/144
6,932,393 B2 * 8/2005 Erices ..... E05B 81/06 292/216
7,125,057 B2 * 10/2006 Coleman ..... E05B 77/26 292/216
7,467,815 B2 * 12/2008 Larsen ..... E05B 81/14 292/201
8,353,542 B2 * 1/2013 Cumbo ..... E05B 77/06 292/196
8,596,696 B2 * 12/2013 Cumbo ..... E05B 85/243 292/201
8,678,452 B2 * 3/2014 Nagaoka ..... E05B 77/265 292/201
8,967,680 B2 * 3/2015 Yokomori ..... B60J 5/00 292/201
9,243,429 B2 * 1/2016 Bendel ..... E05B 77/06
9,874,046 B2 * 1/2018 Wittelsbuerger ..... E05B 77/06
2001/0024040 A1 * 9/2001 Spurr ..... E05B 85/243 292/216
2003/0030287 A1 2/2003 Fisher
2003/0116977 A1 * 6/2003 Erices ..... E05B 81/06 292/201
2005/0212302 A1 * 9/2005 Fisher ..... E05B 81/14 292/216
2005/0218660 A1 * 10/2005 Ijuin ..... E05B 77/26 292/201
2005/0218661 A1 * 10/2005 Brose ..... E05B 81/06 292/216
2006/0006671 A1 * 1/2006 Noel ..... E05B 77/26 292/216
2006/0006672 A1 * 1/2006 Fujihara ..... E05B 83/38 292/216
2006/0055180 A1 * 3/2006 Kachouh ..... E05B 77/36 292/216
2006/0055181 A1 * 3/2006 Berghahn ..... E05B 81/20 292/216
2006/0208504 A1 * 9/2006 Kachouh ..... E05B 85/26 292/216
2006/0226661 A1 * 10/2006 Moore ..... E05B 81/20 292/216
2006/0284426 A1 * 12/2006 Bigazzi ..... E05B 81/14 292/216
2007/0029814 A1 * 2/2007 Coleman ..... E05B 81/14 292/201
2007/0046035 A1 * 3/2007 Tolley ..... E05B 81/06 292/201
2008/0224482 A1 * 9/2008 Cumbo ..... E05B 77/02 292/216
2008/0303291 A1 * 12/2008 Spurr ..... E05B 81/14 292/216
2009/0322104 A1 * 12/2009 Nam ..... E05B 85/243 292/216
2010/0127511 A1 * 5/2010 Vasquez ..... E05B 81/06 292/201
2010/0171321 A1 * 7/2010 Akizuki ..... E05B 77/26 292/200
2010/0236300 A1 * 9/2010 Wilms ..... E05B 81/06 70/91
2010/0283268 A1 11/2010 Cumbo
2011/0074166 A1 * 3/2011 Taurasi ..... E05B 81/14 292/27
2011/0133492 A1 6/2011 Perkins et al.
2011/0204660 A1 8/2011 Cumbo et al.
2012/0068479 A1 * 3/2012 Bendel ..... E05B 81/20 292/200
2012/0181798 A1 * 7/2012 Margheritti ..... E05B 77/32 292/200
2013/0147211 A1 6/2013 Lee et al.
2014/0203572 A1 * 7/2014 Barmscheidt ..... E05B 77/28 292/200
2014/0203575 A1 7/2014 Brickner et al.
2014/0284944 A1 * 9/2014 Rosales ..... E05B 77/06 292/113
2015/0061301 A1 * 3/2015 Torka ..... E05B 77/36 292/194
2015/0115628 A1 * 4/2015 Wittelsbuerger ... E05B 63/0056 292/200
2015/0167364 A1 6/2015 Gweon
2015/0284977 A1 * 10/2015 Barmscheidt ..... E05B 81/14 292/200
2015/0300052 A1 * 10/2015 Barmscheidt ..... E05B 77/02 292/201
2015/0308165 A1 * 10/2015 Scholz ..... E05B 85/26 292/199
2015/0361695 A1 * 12/2015 Lee ..... E05B 85/26 292/200
2015/0368939 A1 * 12/2015 Yamagata ..... E05B 85/02 292/200
2016/0040457 A1 * 2/2016 Yokomori ..... E05B 85/10 292/201
2016/0090759 A1 * 3/2016 Rosales ..... E05B 79/22 292/220

FOREIGN PATENT DOCUMENTS

CN 104675221 A 6/2015
CN 105051305 A 11/2015
DE 4117110 C1 12/1992
EP 2248972 A2 11/2010

OTHER PUBLICATIONS

Written Opinion for French Application No. 1556370; dated Jun. 1, 2016.
English Translation to DE4117110 Abstract.
CN Office Action dated Dec. 3, 2018 for Applicaiton No. 201610524371.9.
CN Office Action dated Mar. 28, 2018 for Applicaiton No. 201610524371.9.
English Translation to CN Office Action dated Dec. 3, 2018 for Applicaiton No. 201610524371.9.
English Translation to CN Office Action dated Mar. 28, 2018 for Applicaiton No. 201610524371.9.
Search Report for CN Application No. 201610524371.9 dated Jul. 5, 2016.

* cited by examiner

INERTIA LOCK FOR VEHICLE LATCH

CROSS REFERENCE TO RELATED APPLICATIONS

This application claims the benefit of French Patent Application No. 15/56370, filed on Jul. 6, 2015, the entire contents of which are incorporated herein by reference thereto.

BACKGROUND

Various embodiments of the present invention relate to a vehicle latch and more particularly, a vehicle latch with an inertia locking device.

Currently, inertial locking systems for vehicle door latches are integrated in the vehicle handle door. If however, the inertia locking system was integrated into the latch, the weight of the vehicle door handle could be reduced. In addition, integration of the system into the latch may provide further cost savings.

Accordingly, it is desirable to provide a vehicle latch with an inertia activated blocking mechanism located in the vehicle latch.

SUMMARY OF THE INVENTION

In one embodiment, a vehicle latch is provided, the vehicle latch having: an inertia lever rotationally mounted to the latch for movement about an axis between a first position and a second position; and a lock link operatively coupled to the inertia lever such that movement of the inertia lever from the first position to the second position causes the lock link to move from a first position to a second position, wherein the latch is in a locked state when the lock link is in the second position.

In another embodiment, a method of locking a vehicle is provided. The method comprising the steps of: rotationally mounting an inertia lever to the latch for movement about an axis between a first position and a second position; and operatively coupling a lock link to the inertia lever such that movement of the inertia lever from the first position to the second position causes the lock link to move from a first position to a second position, wherein the latch is in a locked state when the lock link is in the second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1:
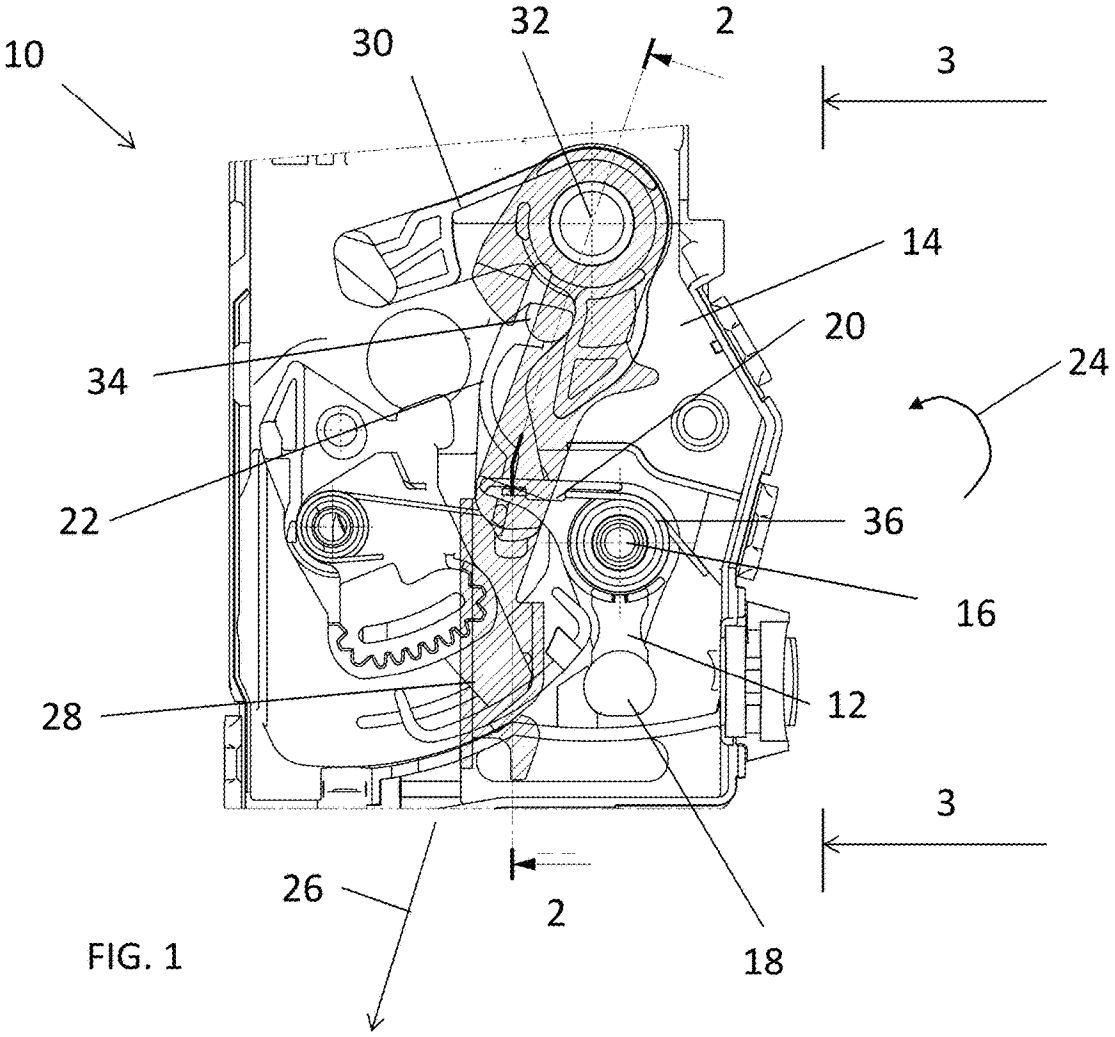
FIG. 1 is a view of a vehicle latch wherein an inertia locking device or inertia lever is in a first or passive unlocking position.
Figure 2:
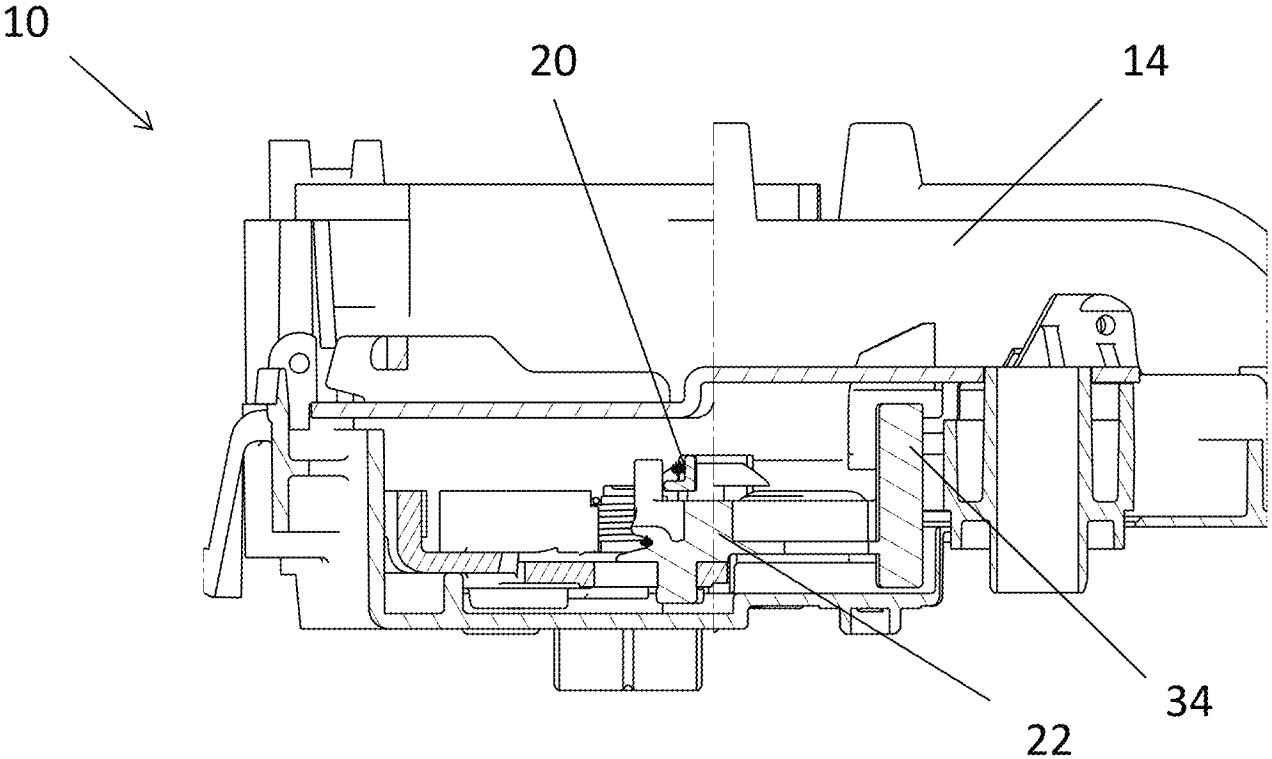
FIG. 2 is a view along lines 2-2 of FIG. 1.
Figure 3:
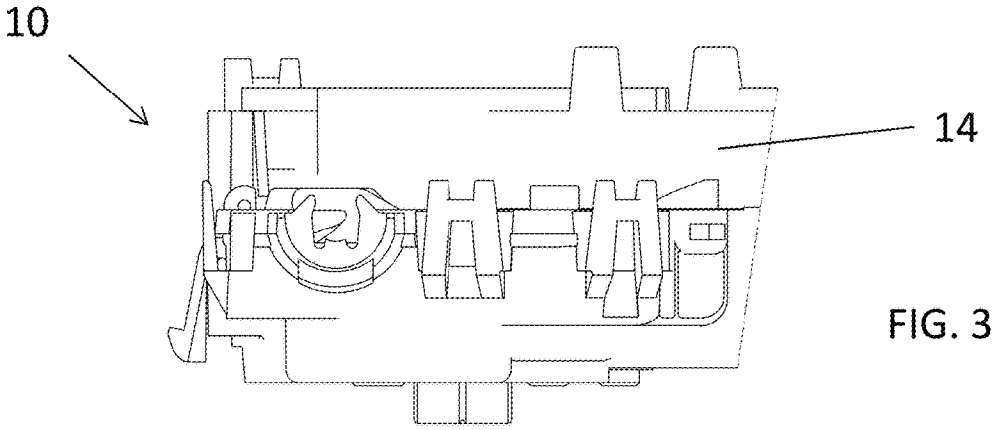
FIG. 3 is a view along lines 3-3 of FIG. 1.
Figure 4:
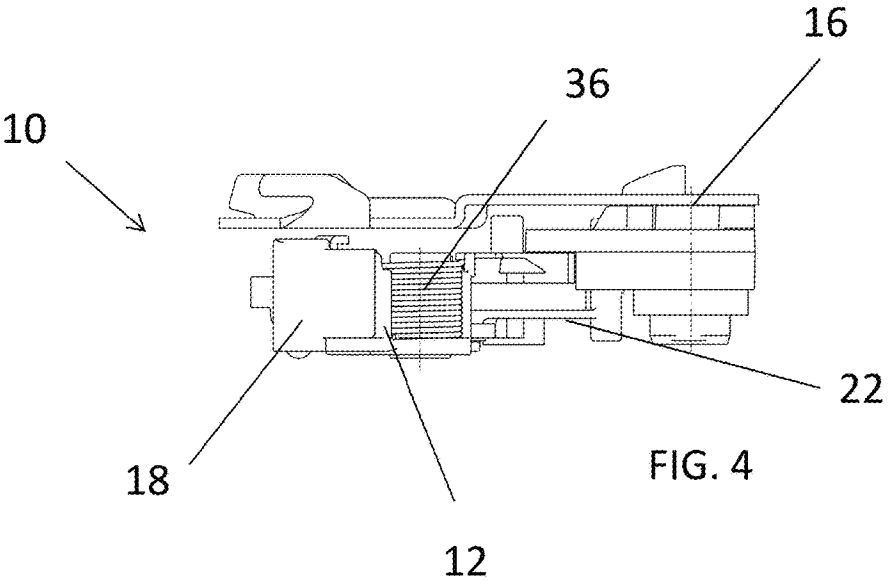
FIG. 4 is a view along lines 3-3 with the associated vehicle latch housing removed.

Although the drawings represent varied embodiments and features of the present invention, the drawings are not necessarily to scale and certain features may be exaggerated in order to illustrate and explain exemplary embodiments of the present invention. The exemplification set forth herein illustrates several aspects of the invention, in one form, and such exemplification is not to be construed as limiting the scope of the invention in any manner.

DETAILED DESCRIPTION

Referring now to the FIGS., portions of a vehicle latch 10 according to embodiments of the present invention are illustrated. In FIGS. 1-5, the vehicle latch 10 is in a first or passive unlocking position while in FIGS. 6-10, the vehicle latch 10 is in a second or active locking position.

During a side impact to the vehicle and/or vehicle door the latch 10 is associated with, an inertia locking device, inertia lever or lever 12 of the vehicle latch 10 is rotated from a first position illustrated in FIGS. 1, 2, 4 and 5 to a second position illustrated in FIGS. 6, 7, 9 and 10. The inertia locking device, inertia lever or lever 12 is rotatably mounted to the latch 10 so that it is located within a housing 14 of the vehicle latch 10 and is configured for movement about an axis 16. In one embodiment, the inertia lever 12 is rotationally mounted to the housing 14 or alternatively to any other portion of the latch 10. The inertia lever 12 has an integral mass 18 located away from axis 16 and an arm portion 20 that is operatively coupled to a lock link or member 22 such that as the inertia lever 12 is rotated from its first position in the direction of arrow 24 about axis 16, the arm portion 20 causes lock link 22 to move from a first position (illustrated in at least FIGS. 1, 2, 4 and 5) in the direction of arrow 26 to a second position (illustrated in at least FIGS. 1, 2, 4 and 5). In one non-limited embodiment, the movement of the lock link 22 may be in a linear direction as opposed to a rotational direction. Of course and in alternative embodiments, the movement of lock link 22 may be rotational or a combination of rotational or linear movement.

When the lock link 22 is in its first position it operatively couples components of the vehicle latch 10 together such that operation of an outside handle or alternatively any other handle external or internal will release the latch 10 and allow a vehicle door to open. Movement of the lock link 22 into the second position will cause the vehicle latch 10 to be in a locked state such that movement of an outside handle or alternatively any other handle external or internal and/or cables or rods associated with the handle and linking it to the latch 10 will not cause the latch 10 to transition from a latched state to an unlatched state. In other words and when the inertia lever 12 and the lock link 22 are in their respective second positions, the vehicle latch 10 is locked and movements of components associated with operation of a release handle of the vehicle will not release the latch and the associated door of the latch will remain in a closed position.

For example and in one non-limiting embodiment, the lock link 22 may operably couple a release lever 28 to a pawl lifter 30 each of which are rotationally mounted to the latch 10 or housing 10 for movement about an axis 32. Accordingly and when the lock link 22 is in its first position, the release lever 28 and the pawl lifter 30 are operatively coupled to each other in order to open or release the latch due to actuation of a vehicle door handle. Conversely and when the lock link 22 and the inertia lever 12 are in their respective second positions, the release lever 28 and the pawl lifter 30 are decoupled from each other. Of course, other movable components of the latch 10 may be operably coupled and decoupled from each other by lock link 22 in order to provide the desired effect of locking and unlocking the vehicle latch 10.

In one non-limiting embodiment, movement of an external door handle and its associated cables and/or rods will cause the required movement of the movable components such as but not limited to the release lever 28 and the pawl lifter 30 such that the latch 10 can be moved from a latched state to an unlatched state and the vehicle door associated with latch 10 can be opened. For example and in one non-limiting embodiment, this movement will cause a pawl of the latch 10 to no longer engage a claw of the latch 10 in order to release the latch 10 and allow the door to open. Of course, other movable components of the latch 10 may be operably coupled and decoupled from each other by lock link 22.

In one non-embodiment, release lever 28 may be operatively coupled to pawl lifter 30 by at least a portion 34 of lock link 22, which when in the first position causes release lever 28 and pawl lifter 30 to be operatively coupled together. When the lock link 22 moves in the direction of arrow 26 into its second position, the release lever 28 and the pawl lifter 30 are no longer operatively coupled together as portion 34 and lock link 22 has been moved into their second positions.

Still further and in alternative embodiments of the invention other portions of the lock link 22 may be used instead of portion 34 to couple and decouple movable components of the latch 10 to and from each other in order to prevent the latch 10 from being released when the lock link 22 is in its second position. As mentioned above and in alternative embodiments, other movable components of the latch 10 may be operably coupled and decoupled to and from each other due to the movement of the lock link 22 between its first position and its second position due to the rotational movement of inertia lever 12 between its first position and its second position as the inertia lever 12 is rotationally mounted in latch 10.

As mentioned above and when the inertia lever 12 is in its second position, movement of a vehicle door handle and its associated cables and/or rods are prevented from releasing latch 10 since lock link 22 has decoupled the movable components that would unlatch the latch 10 and release the vehicle door the latch 10 is associated with.

Still further and in alternative embodiments other portions of the lock link 22 may be used instead of portion 34 to couple and decouple movable components of the latch 10 to and from each other in order to prevent the latch 10 from being released when the lock link 22 is in its second position and allow for normal operation of the latch 10 when the lock link 22 is in the first position.

In still yet another alternative embodiment, portion 34 may be used in combination with other portions of the lock link 22 to couple and decouple movable components of the latch 10 to and from each other in order to prevent the latch 10 from being released when the lock link 22 is in its second position. Thereafter and when the latch lock link 22 is returned to its first position the movable components are once again coupled to each other and movement of a handle and its associated cables and/or rod of the latch 10 will transition the latch 10 into an unlatched state so that the latch 10 is released and the vehicle door can be opened.

Figure 5:
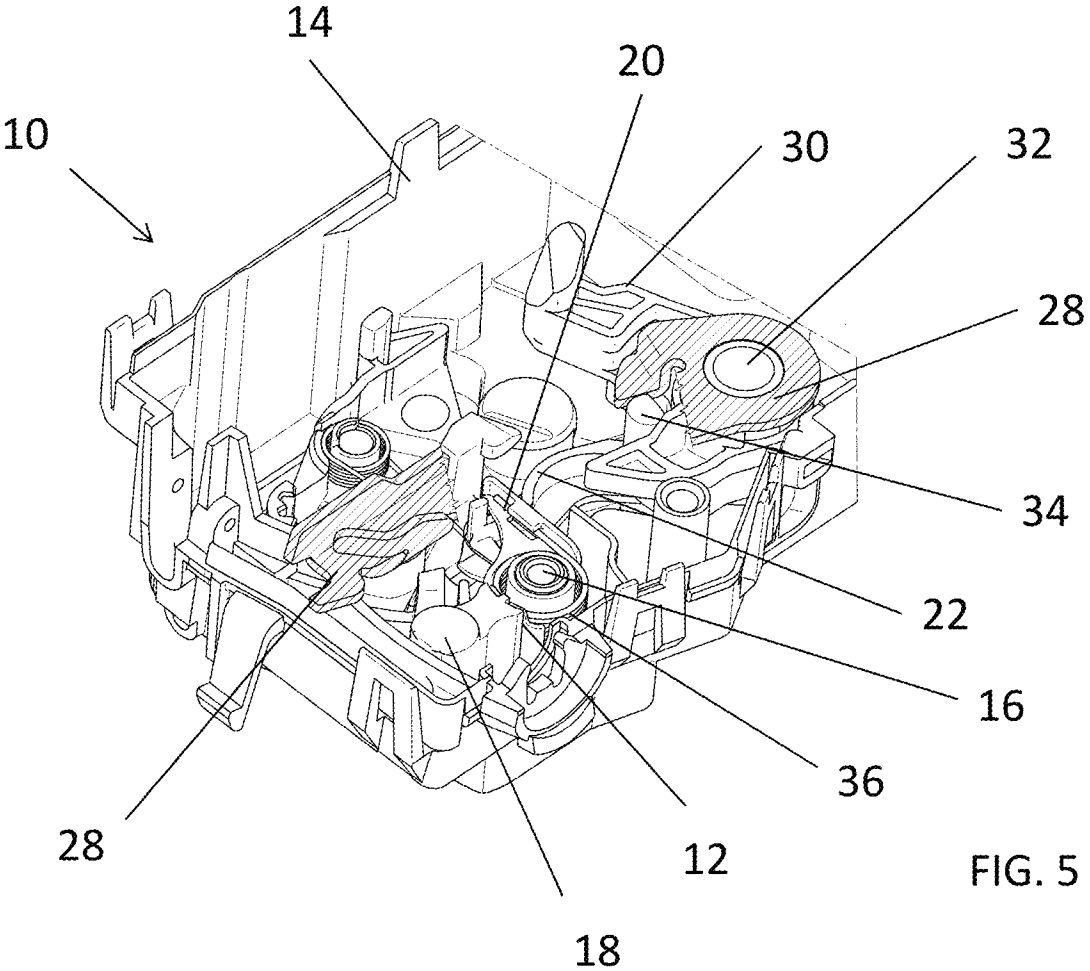
FIG. 5 is a perspective view of a vehicle latch wherein the inertia locking device or inertia lever is in the first or passive unlocking position.
Figure 6:
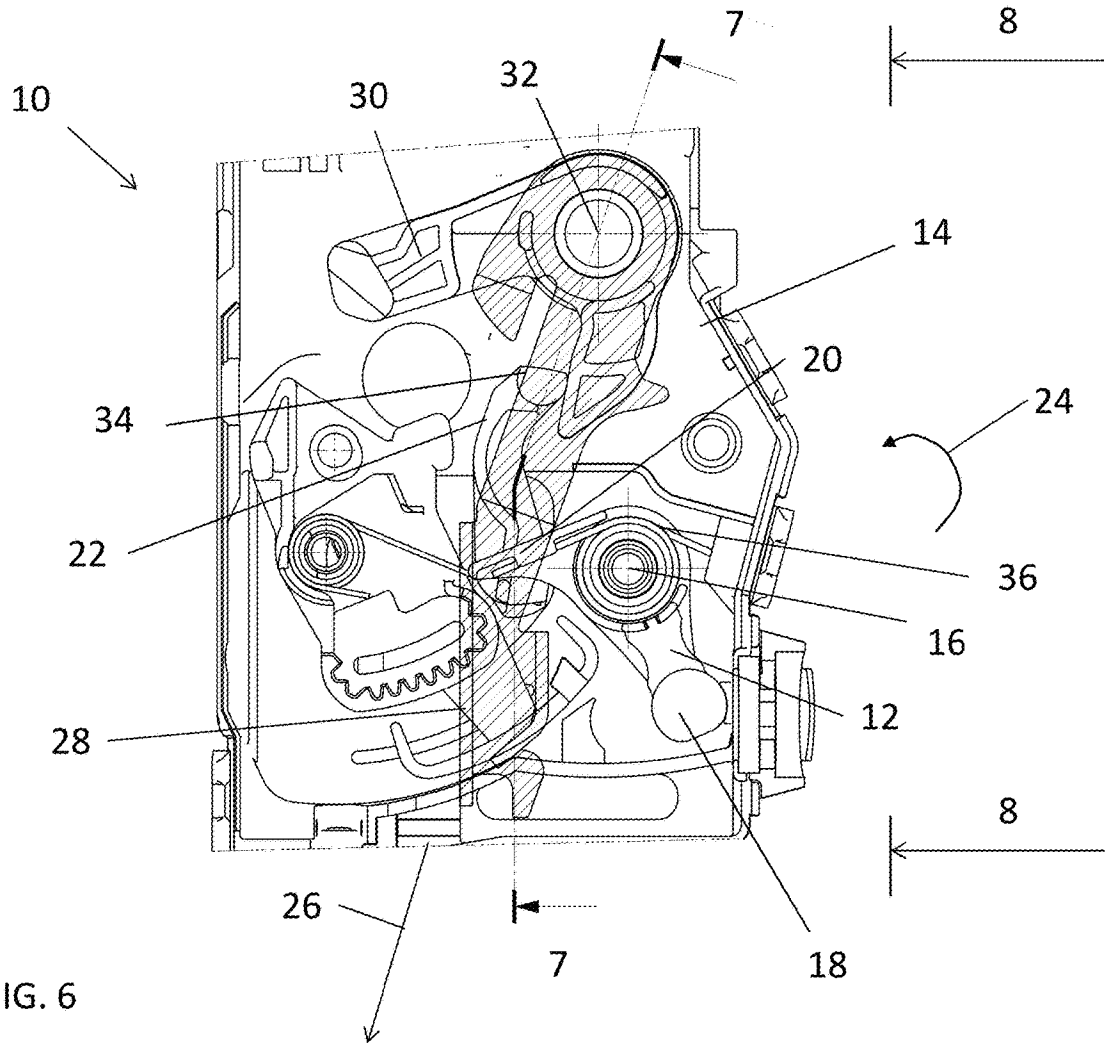
FIG. 6 is a view of a vehicle latch wherein the inertia locking device or inertia lever is in a second or active locking position.
Figure 7:
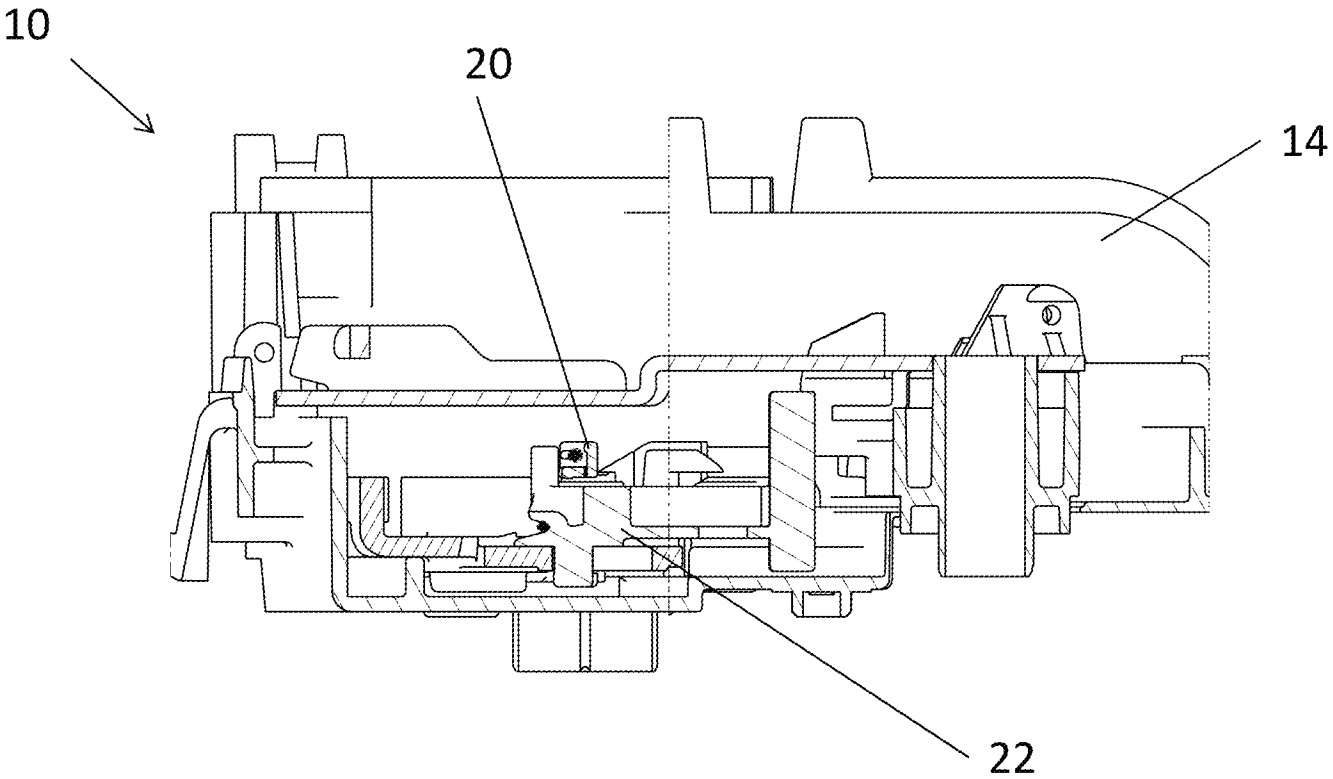
FIG. 7 is a view along lines 7-7 of FIG. 6.
Figure 9:
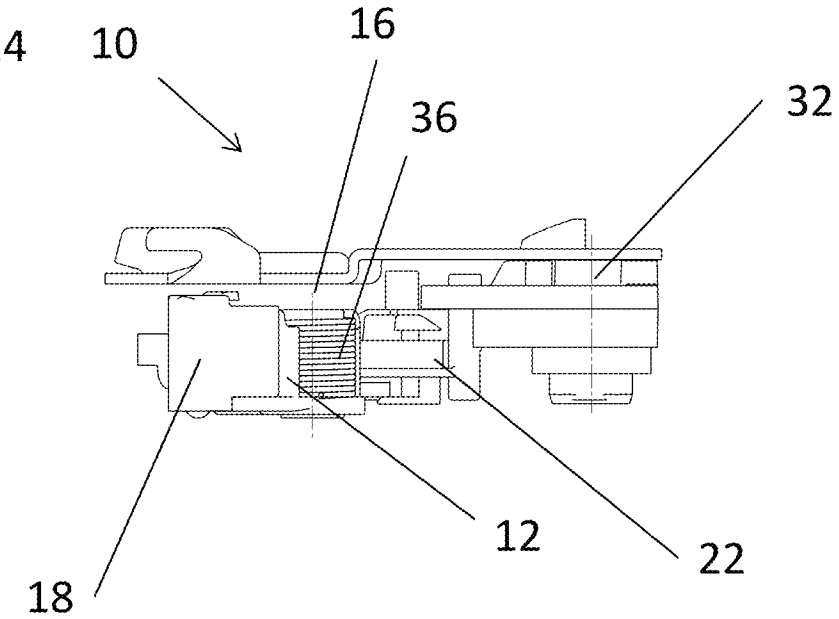
FIG. 9 is a view along lines 8-8 with the associated vehicle latch housing removed.
Figure 8:
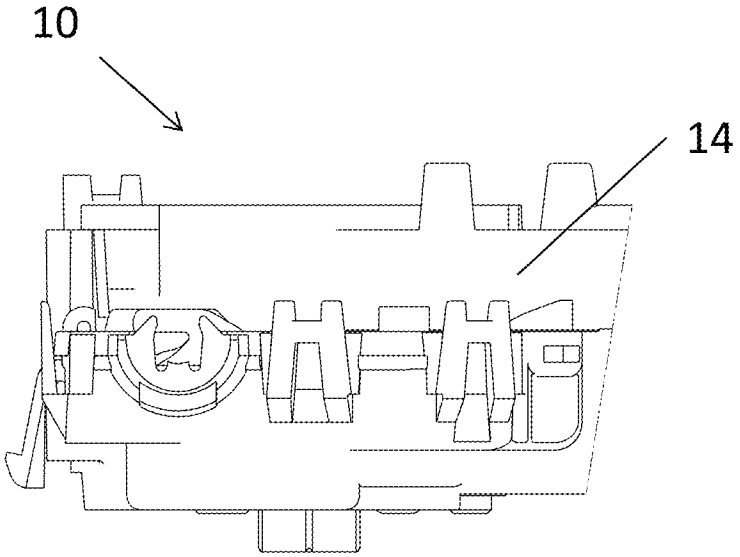
FIG. 8 is a view along lines 8-8 of FIG. 6.
Figure 10:
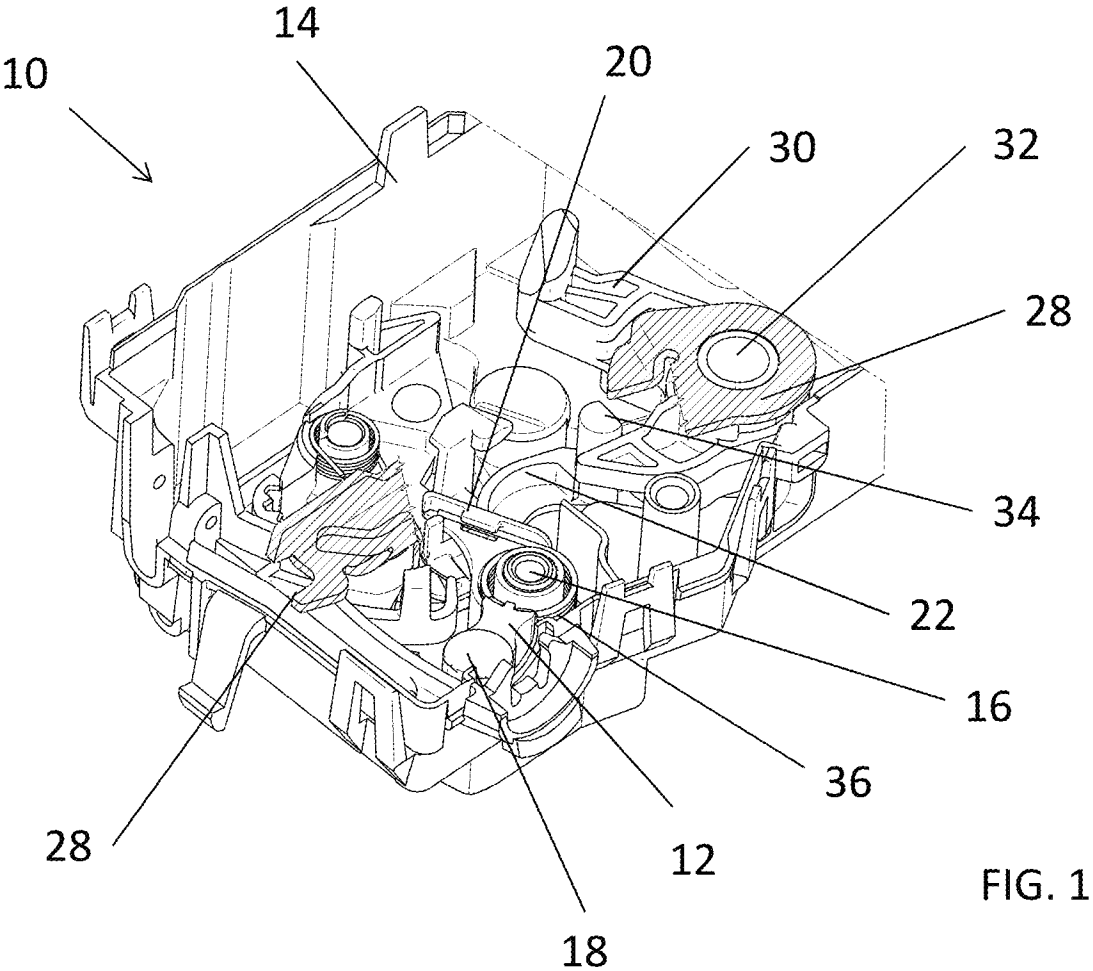
FIG. 10 is a perspective view of a vehicle latch wherein the inertia locking device or inertia lever is in the second or active locking position.

FIGS. 5 and 10 illustrate portions of the latch 10, wherein the release lever 28 is only partially illustrated such that the components below release lever 28 can be easily viewed.

Movement of the lock link 22 into the second position will cause the vehicle latch 10 to be in a locked state such that movement of an external handle or alternatively any other handle and/or cables or rods associated with the external handle and linking it to the latch 10 will not cause the latch 10 to transition from a latched state to an unlatched state. In other words and when the inertia lever 12 and the lock link 22 are in their respective second positions, the vehicle latch 10 is locked and movements of components associated with operation of an outside release handle or alternatively any other handle of the vehicle will not release the latch and the associated door of the latch will remain in a closed position.

As illustrated in the attached FIGS., the inertia lever 12 is spring biased into its first position by a spring 36 such that the inertia lever 12 is generally retained in its first position. However and should the vehicle latch 10 be subject to an impact or shock sufficient enough to create a moment of inertia to create an angular acceleration sufficient to move the inertia lever 12 about axis 16 from the first position to the second position. The inertia lever 12 and associated lock link 22 will move into their second positions. The required moment of inertia to move inertia lever 12 from its first position to its second position can be determined by the weight of mass 18 its distance from axis 16, the spring constant of spring 36 as well as any resistive forces associated with sliding the lock link 22 from its first position to its second position. Thus, the inertia lever 12 can be designed to transition from its first position to its second position when a predetermined force is applied to the vehicle latch 10.

As such and during the shock of an impact to the vehicle latch 10 greater than a predetermined value, the inertia lever 12 will rotate in the direction of arrow 24 and move the lock link 22 into its second position such that the latch 10 is in a locked state. When in the locked state kinematic forces to the vehicle and/or latch will not release the latch and the associated vehicle door will stay in its closed position.

Once the forces applied to the vehicle and/or latch 10 are removed, the spring biasing force of spring 36 in a direction opposite to arrow 24 will return the inertia lever 12 and the lock lever 22 to their respective first positions and the movable components of the latch 10 required for opening the vehicle door lifter are again operatively coupled together.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced items. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vehicle latch, comprising:

an inertia lever rotationally mounted to the latch for movement about an axis between a first position and a second position; and a lock link operatively coupled to the inertia lever such that movement of the inertia lever from the first position to the second position causes the lock link to move from a first position to a second position, wherein the latch is in a locked state when the lock link is in the second position, and wherein the lock link operatively couples a release lever to a pawl lifter of the latch via a protrusion that extends away from a surface of the lock link, and wherein the release lever and the pawl lifter are each rotationally secured to the latch for rotational movement about another axis such that the release lever and the pawl lifter are each rotationally secured to the another axis.

2. The vehicle latch as in claim 1, wherein the inertia lever is spring biased into the first position.

3. The vehicle latch as in claim 2, wherein the inertia lever has an integral mass located away from the axis.

4. The vehicle latch as in claim 1, wherein the inertia lever has an arm portion that is operatively coupled to the lock link.

5. The vehicle latch as in claim 1, wherein the lock link moves in a linear direction as it moves from its first position to its second position.

6. The vehicle latch as in claim 1, wherein the latch is in an unlocked state when the inertia lever and the lock link is in the first position.

7. A method of locking a vehicle latch, comprising:

rotationally mounting an inertia lever to the latch for movement about an axis between a first position and a second position;

operatively coupling a lock link to the inertia lever such that movement of the inertia lever from the first position to the second position causes the lock link to move from a first position to a second position, wherein the latch is in a locked state when the lock link is in the second position;

rotationally mounting a release lever and a pawl lifter to the latch, wherein the release lever and the pawl lifter are each rotationally secured to the latch for rotational movement about another axis such that the release lever and the pawl lifter are each rotationally secured to the another axis; and operatively coupling the release lever to the pawl lifter via a protrusion that extends away from a surface of the lock link when the lock link is in the second position.

8. The method as in claim 7, wherein the inertia lever is spring biased into the first position.

9. The method as in claim 8, wherein the inertia lever has an integral mass located away from the axis.

10. The method as in claim 7, wherein the inertia lever has an arm portion that is operatively coupled to the lock link.

11. The method as in claim 7, wherein the lock link moves in a linear direction as it moves from its first position to its second position.

12. The method as in claim 7, wherein the latch is in an unlocked state when the inertia lever and the lock link is in the first position.

13. The method as in claim 7, wherein the inertia lever has an integral mass located away from the axis and wherein the inertia lever has an arm portion that is operatively coupled to the lock link.

14. The method as in claim 13, wherein the lock link moves in a linear direction as it moves from its first position to its second position.

15. The vehicle latch as in claim 1, wherein the inertia lever has an integral mass located away from the axis and wherein the inertia lever has an arm portion that is operatively coupled to the lock link.

16. The vehicle latch as in claim 15, wherein the lock link moves in a linear direction as it moves from its first position to its second position and wherein the latch is in an unlocked state when the inertia lever and the lock link is in the first position.

* * * * *